US006705217B1

(12) United States Patent
Godsey et al.

(10) Patent No.: US 6,705,217 B1
(45) Date of Patent: Mar. 16, 2004

(54) DEVICE FOR HOLDING OBJECTS TO BE TREATED

(76) Inventors: Donald W. Godsey, 3600 Gold Point Cir., Hixson, TN (US) 37343; Michael R. Davis, 922 Wellington La., Hixson, TN (US) 37343

( * ) Notice: Subject to any disclaimer, the term of this patent is extended or adjusted under 35 U.S.C. 154(b) by 161 days.

(21) Appl. No.: 09/935,307

(22) Filed: Aug. 21, 2001

(51) Int. Cl.[7] ..... B41F 17/30

(52) U.S. Cl. ..... 101/35; 101/DIG. 40; 269/170; 269/203; 269/268

(58) Field of Search ..... 451/49, 50, 262; 101/35, 114, 127, DIG. 40; 269/182, 170, 268, 166, 168, 203, 204

(56) References Cited

U.S. PATENT DOCUMENTS

| | | | | |
|---|---|---|---|---|
| 2,405,344 A | | 8/1946 | Cloutier | |
| 2,438,773 A | | 3/1948 | Warlick | |
| 2,479,898 A | | 8/1949 | Beaudette | |
| 3,085,476 A | | 4/1963 | Sloan et al. | |
| 3,106,113 A | | 10/1963 | Trimble | |
| 3,111,789 A | | 11/1963 | Harmon | |
| 3,133,383 A | | 5/1964 | Chapman | |
| 3,167,884 A | | 2/1965 | Thompson | |
| 3,575,405 A | * | 4/1971 | Harding | 269/258 |
| 3,640,028 A | | 2/1972 | Richard | |
| 3,914,830 A | * | 10/1975 | Bolton | 24/490 |
| 4,086,851 A | | 5/1978 | Brandell | |
| 4,137,315 A | * | 1/1979 | Farge et al. | 514/233.2 |
| 4,251,065 A | * | 2/1981 | McDougal | 269/25 |
| 4,803,922 A | * | 2/1989 | Dennesen | 101/41 |
| 5,197,360 A | * | 3/1993 | Wooster, Jr. | 81/487 |
| 5,484,329 A | | 1/1996 | Engelbrektson | |
| 5,521,459 A | * | 5/1996 | Kim | 313/36 |
| 5,564,707 A | | 10/1996 | Dinh | |
| 5,584,183 A | * | 12/1996 | Wright et al. | 62/3.7 |
| 5,611,723 A | | 3/1997 | Mitoma et al. | |
| 5,658,188 A | | 8/1997 | Yamada et al. | |
| 5,806,419 A | * | 9/1998 | Adner et al. | 101/35 |
| 5,853,168 A | * | 12/1998 | Drake | 269/6 |
| 5,878,659 A | | 3/1999 | Hatter | |
| 6,004,223 A | | 12/1999 | Newcomb | |
| 6,021,537 A | | 2/2000 | Smith | |
| 6,098,973 A | * | 8/2000 | Khachatoorian | 269/182 |
| 6,120,394 A | | 9/2000 | Kametani | |
| 6,125,747 A | | 10/2000 | Elliott | |
| 6,129,611 A | | 10/2000 | Yamaguchi | |
| 6,209,452 B1 | | 4/2001 | Klimek | |
| 6,382,608 B1 | * | 5/2002 | Michell | 269/6 |
| 6,412,767 B1 | * | 7/2002 | Beckmann et al. | 269/166 |
| 6,522,953 B1 | * | 2/2003 | Schneider | 700/275 |
| 2001/0012389 A1 | * | 8/2001 | Welchman et al. | 382/141 |
| 2001/0045695 A1 | * | 11/2001 | Andronica | 269/268 |

FOREIGN PATENT DOCUMENTS

| | | |
|---|---|---|
| DE | 29808618 U1 | 10/1998 |
| JP | 61188312 | 8/1986 |
| WO | WO 00/67853 | 11/2000 |

* cited by examiner

*Primary Examiner*—Andrew H. Hirshfeld
*Assistant Examiner*—Kevin D. Williams
(74) *Attorney, Agent, or Firm*—Luedeka, Neely & Graham, PC

(57) ABSTRACT

A device for holding a golf ball during printing of indicia thereon. The device includes a base, a stationary member attached to the base and having a surface for engaging a portion of the golf ball, a clamping member slidably mounted on the base and having a surface for engaging a portion of the golf ball, and positioning members having springs that urge the clamping member toward the stationary member.

1 Claim, 12 Drawing Sheets

DEVICE FOR HOLDING OBJECTS TO BE TREATED

FIELD OF THE INVENTION

This invention relates generally to device for positioning workpieces. More particularly, this invention relates to a device for maintaining a spherical workpiece, such as a golf ball, in a desired position during application of printing thereto.

BACKGROUND AND SUMMARY OF THE INVENTION

In automated or assembly line type processes, multiple identical workpieces travel past a work station for treatment therein. For example, in an automated process for printing custom logos or other indicia on a golf ball, golf balls are conveyed through a printing station for printing of desired indicia thereon. One problem associated with automated printing of golf balls is maintaining the golf balls in a desired position so that the custom logo is applied in a desired orientation relative to other indicia already present on the balls, such as the manufacturer's brand. Accordingly, the present invention relates to a device for holding objects to be treated, such as golf balls to be printed.

In a preferred embodiment, the device includes a base, a stationary member attached to the base and having a surface for engaging a portion of the golf ball, a clamping member slidably mounted on the base and having a surface for engaging a portion of the golf ball, and a positioning member having a spring that bears against the clamping member to urge the clamping member toward the stationary member.

Another aspect of the invention relates to a system for holding and conveying an object through a treatment zone.

In a preferred embodiment, the system includes a conveyor system having a guide rail and a holder operatively associated with the conveyor system for holding the object.

The holder preferably includes a base attachable to the conveyor system to enable the conveyor system to travel the holder in a desired direction, a first member fixedly secured to the base, the first member having an object engaging surface configured for mateably engaging a first surface of the object to be held; and a second member located adjacent the base and the first member and being movably positionable relative to the first member and the base, the second member having an object engaging surface configured for mateably engaging a second surface of the object to be held.

A positioning system associated with the second member movably positions the second member relative to the first member and the base. The positioning system preferably includes a rod that extends between the first and second members and is fixedly connected to the first member and slidably received by the second member. A spring is positioned on the rod and located so as to bear against a portion of the second member to urge it toward the first member. A guide member is connected to the second member and positioned so as to engage the guide rail of the conveyor assembly as the holder is conveyed by the conveyor system in the desired direction, wherein when the guide member is in engagement with the guide rail, the second member is urged in a direction generally away from the first member.

BRIEF DESCRIPTION OF THE DRAWINGS

Further aspects of the invention will become apparent by reference to the detailed description of preferred embodiments when considered in conjunction with the figures, which are not to scale, wherein like reference numbers, indicate like elements through the several views, and wherein.

DETAILED DESCRIPTION

With initial reference to the drawings, the invention relates to a device for holding a workpiece for treatment thereof. In a preferred embodiment, the device may be configured for holding a spherical object, such as a golf ball, to maintain the object in a desired orientation during a printing step. In a further aspect, the device or a plurality of the devices may be mounted to a conveyor or the like operatively associated with a printing machine for automated printing of the workpieces. The device is desirably configured to enable workpieces, such as golf balls, to be quickly and securely received by the device, yet be quickly and easily removed therefrom after treatment, such as printing, has been effected.

Figure 1:
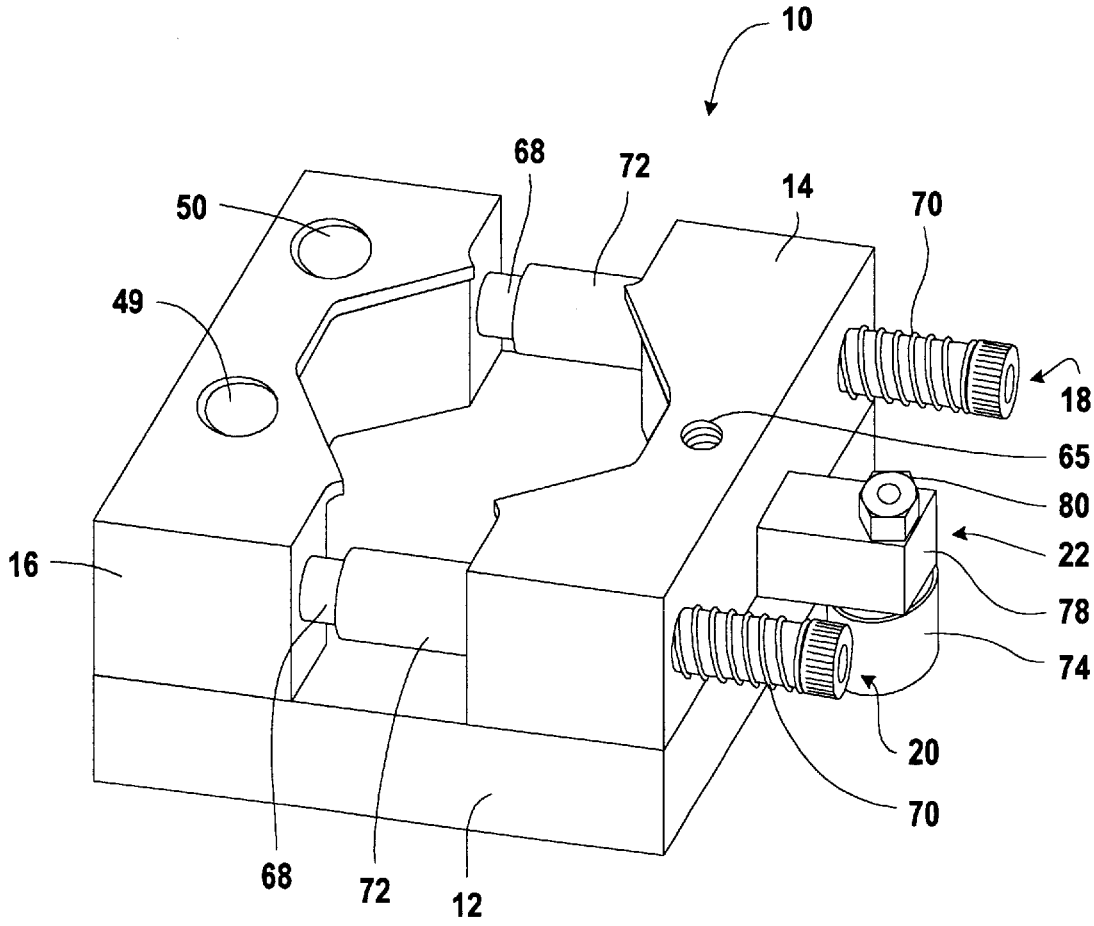
FIG. 1 is a perspective view of a preferred embodiment of a holding device in accordance with one aspect of the invention.
Figure 2:
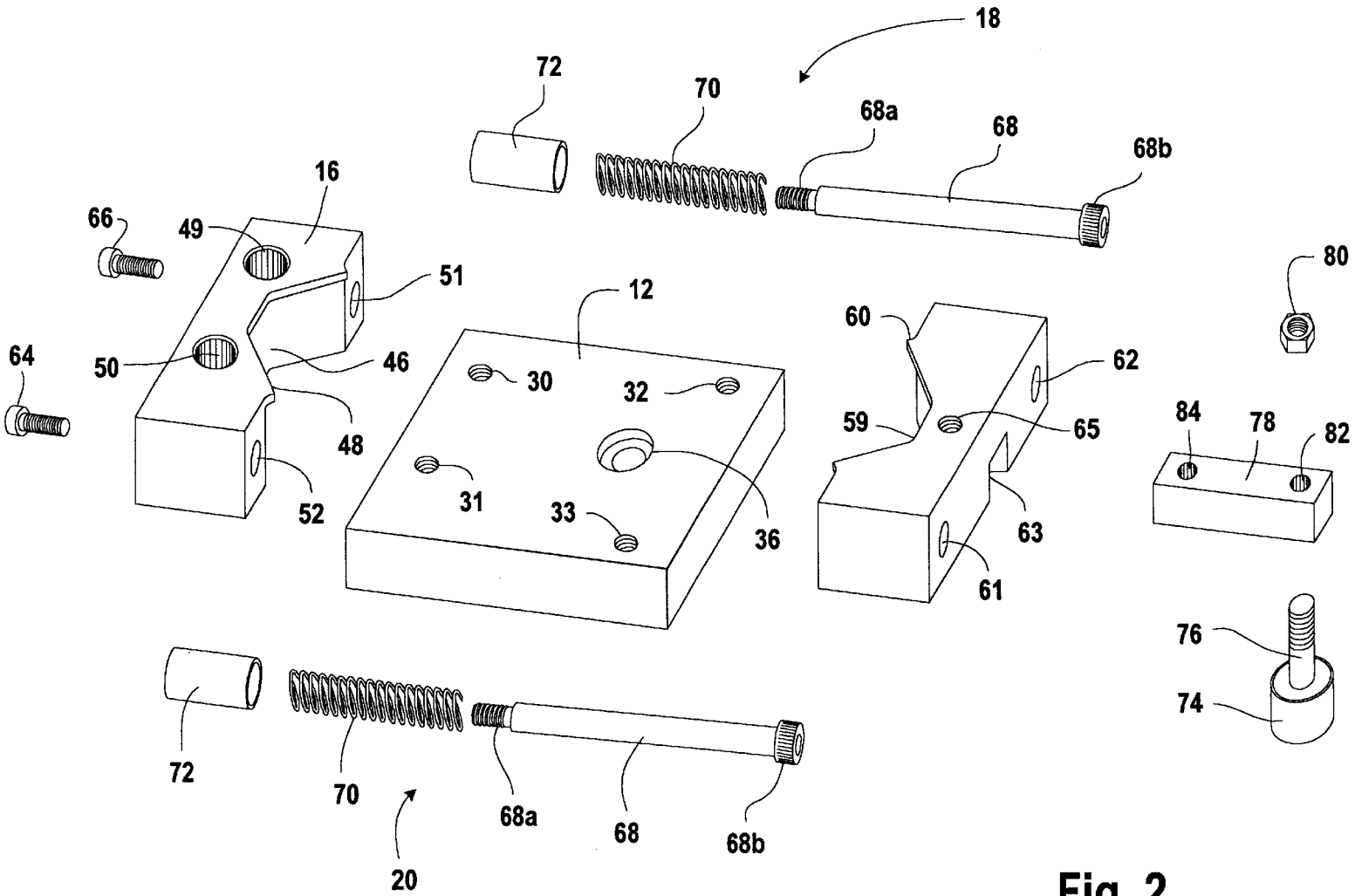
FIG. 2 is an exploded top view of the device of FIG. 1.

FIGS. 1 and 2 show assembled and exploded views, respectively, of a holding device 10 in accordance with a preferred embodiment of the invention. The device 10 is configured for holding a spherical object, such as a golf ball, and preferably includes a base 12, a clamping block 14, a stationary block 16, a pair of positioning systems 18 and 20, and a guide roller assembly 22.

The stationary block 16 is preferably attached directly to the base 12. The clamping block 14 is positioned on the base 12 opposite the stationary block 16 by the positioning systems 18 and 20 so that the clamping block 14 is yieldably positionable relative to the stationary block 16.

An external force may be applied to urge the clamping block 14 away from the stationary block 16 to enable a workpiece to be inserted between clamping block 14 and the stationary block 16. Upon removal of the force, the positioning systems 16 and 18 urge the clamping block 14 toward the stationary block and frictionally retain the workpiece therebetween adjacent the base 12.

The device 10 is also preferably configured to cooperate with a conveyor system for automated travel of the held workpiece through a work station, such as a printing station.

Base 12

Figure 3:
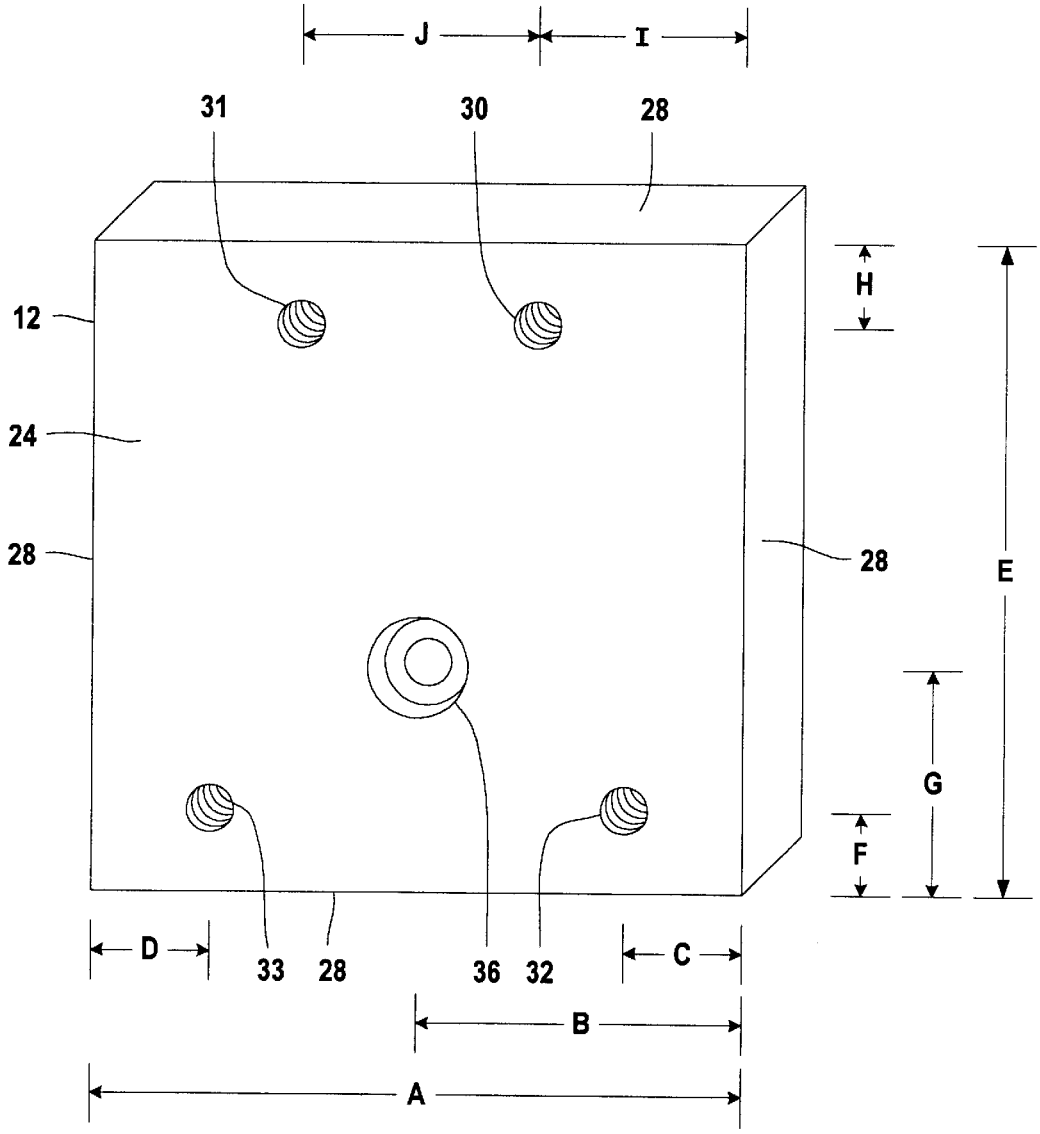
FIG. 3 is a top view of a base component of the device of FIG. 1.
Figure 4:
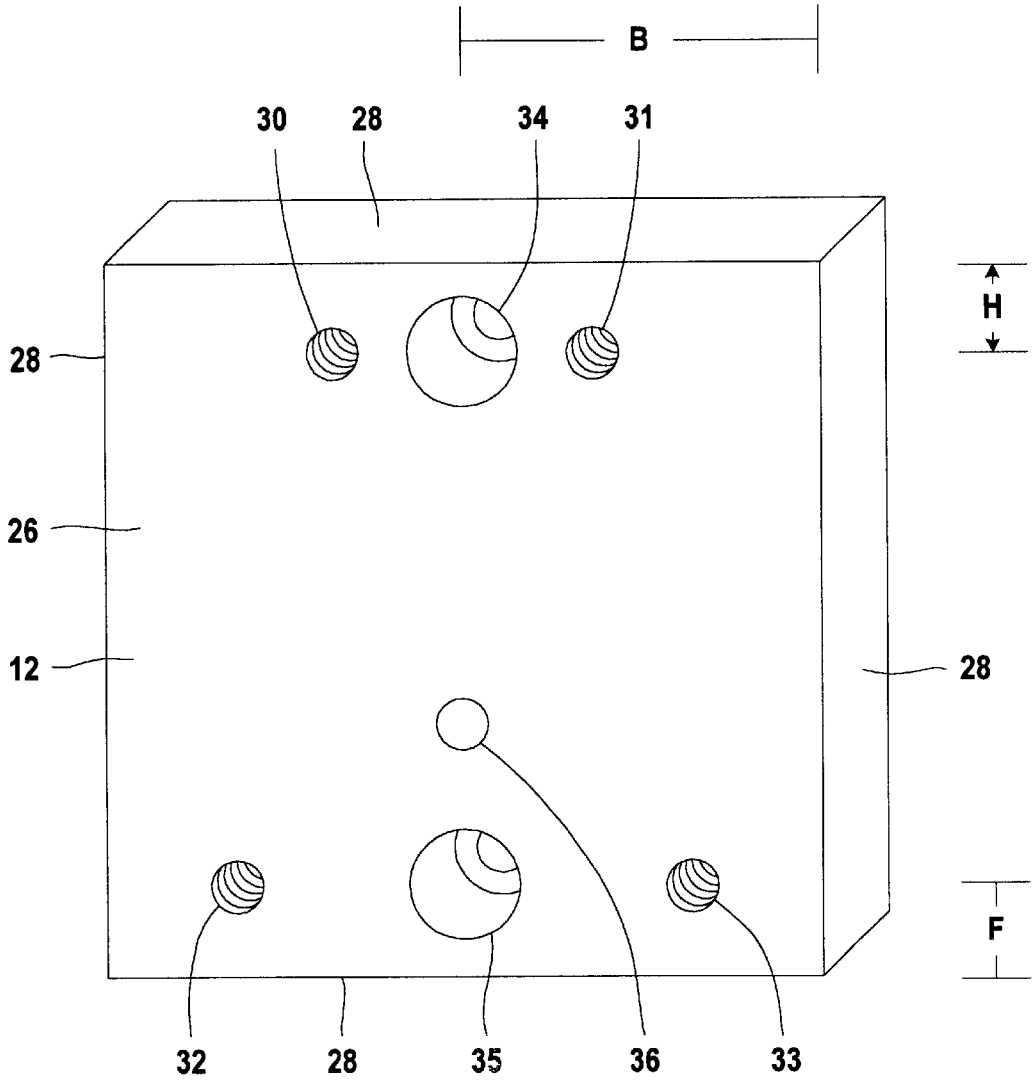
FIG. 4 is a bottom view of the base component of FIG. 3.

With reference to FIGS. 3 and 4, the base 12 is preferably of one-piece metal construction, such as aluminum, having a generally square or rectangular shape and including a top 24, a bottom 26, and four sides 28. The base 12 preferably includes various features such as bores and apertures to facilitate securement of other device components thereto and/or for securing the base 12 to a conveyor or the like.

For example, threaded apertures 30,31,32, and 33 are preferably located through the base, extending from the top 24 to the bottom 26, and each having a diameter of from about ⅛ to about ¼ inch. Blind bores or apertures 34 and 35 are also preferably located so as to extend into the bottom 26, preferably having a depth of from about ¼ to about ½ inch and a diameter of from about ¼ to about ½ inch. An aperture 36 is also preferably located to extend through the base. The aperture 36 preferably has a first diameter of from about ¼ to about ½ inch adjacent the top 24 and extending to a depth of from about ⅛ to about ⅜ inch, and a second diameter of from about ⅛ to about ¼ inch for the remainder thereof.

Stationary Block 16

Figure 5:
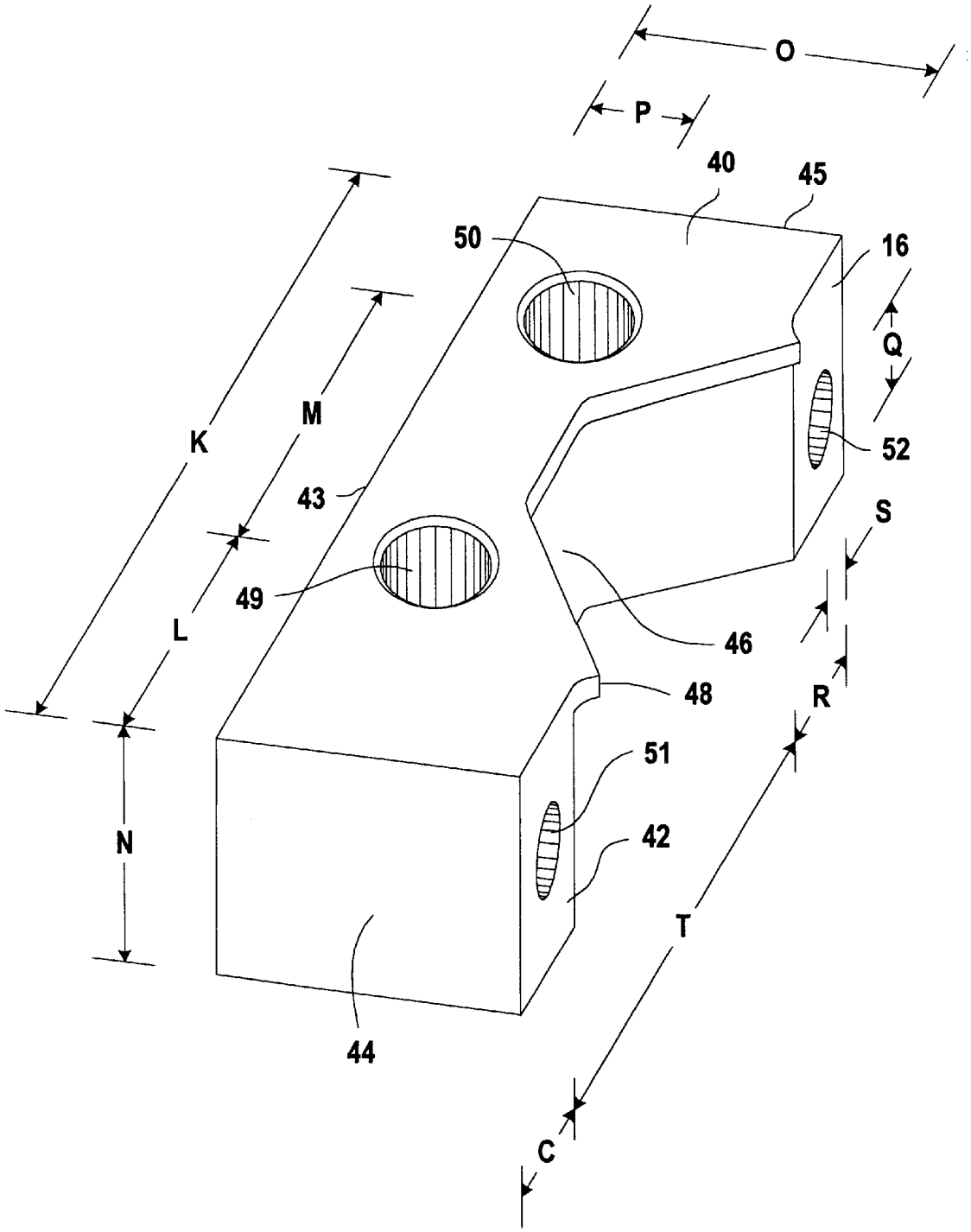
FIG. 5 is a top perspective view of a stationary block component of the device FIG. 1.
Figure 6:
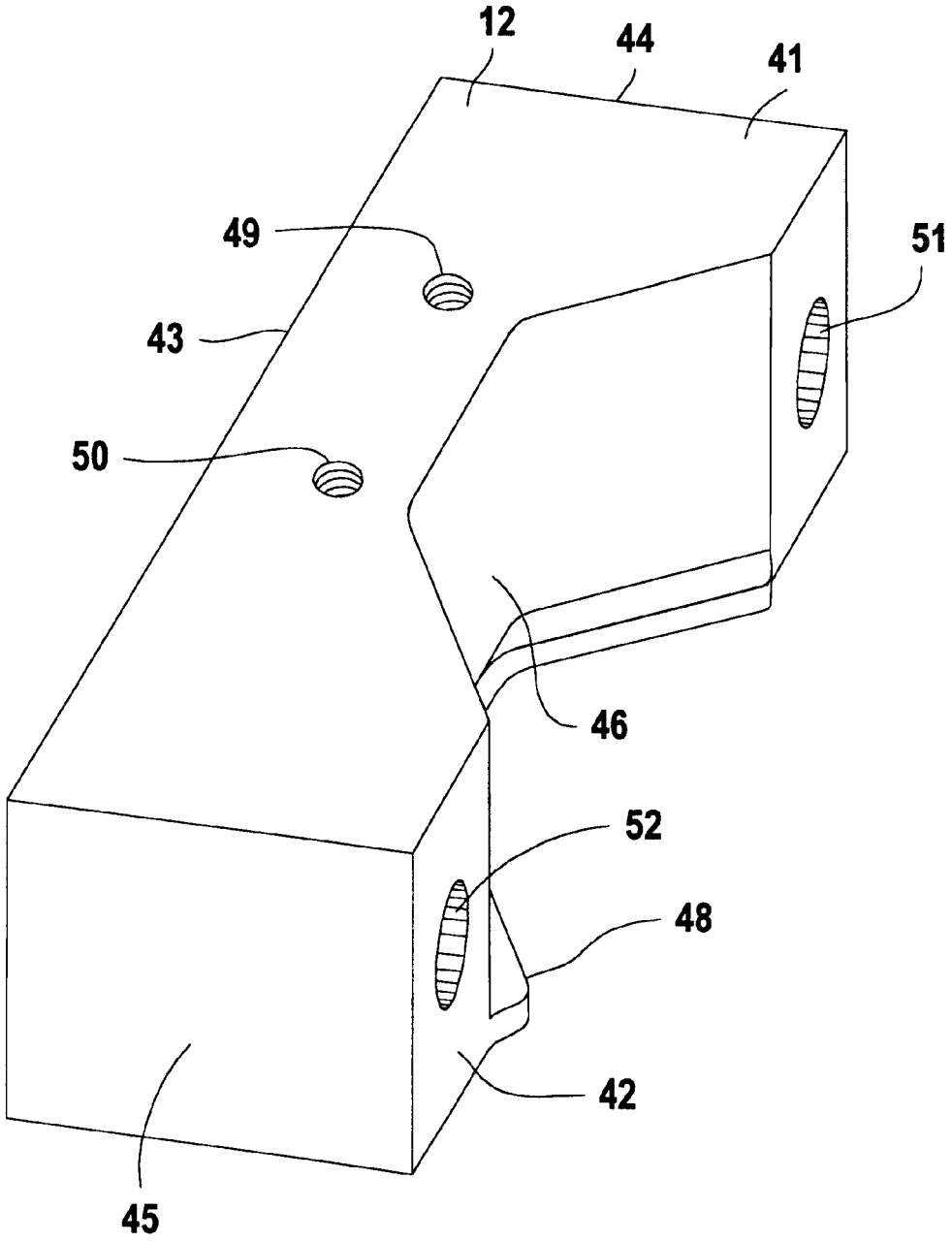
FIG. 6 is a bottom perspective view of the block component of FIG. 5.

Turning to FIGS. 5 and 6, the stationary block 16 preferably has atop 40, bottom 41, notched front 42, back 43, and opposite sides 44 and 45. An angled notched surface 46 is preferably included on the front 42 of the stationary block. A lip 48 is preferably located around the top of the notched surface 46. As will be appreciated, the profile of the surface 46 is substantially the shape of a pyramid.

To facilitate attachment of the block 16 to the base 12 and/or for installation of the positioning systems 18 and 20, various bores, apertures, and the like may be provided on the block 16. For example, apertures 49 and 50 preferably extend between the top 40 and bottom 41 of the block 16, each preferably having a first diameter of from about ½ to about 1 inch adjacent the top 40 and extending to a depth of from about ½ to about ¾ inch, and a second diameter of from about ⅛ to about ¼ inch for the remainder thereof. Apertures 51 and 52 extend between the front 42 and the back 43, each preferably having a first diameter of from about ⅛ to about ⅜ inch adjacent the front 42 and extending to a depth of from about ½ to about ¾ inch, and a second threaded diameter of from about ⅛ to about ¼ inch for the remainder thereof. The stationary block 16 may be mounted to the base 12 as by screws 64 and 66 engaging the apertures 49 and 50 of the stationary block and the threaded apertures 30 and 31 of the base.

Clamping Block 14

Figure 7:
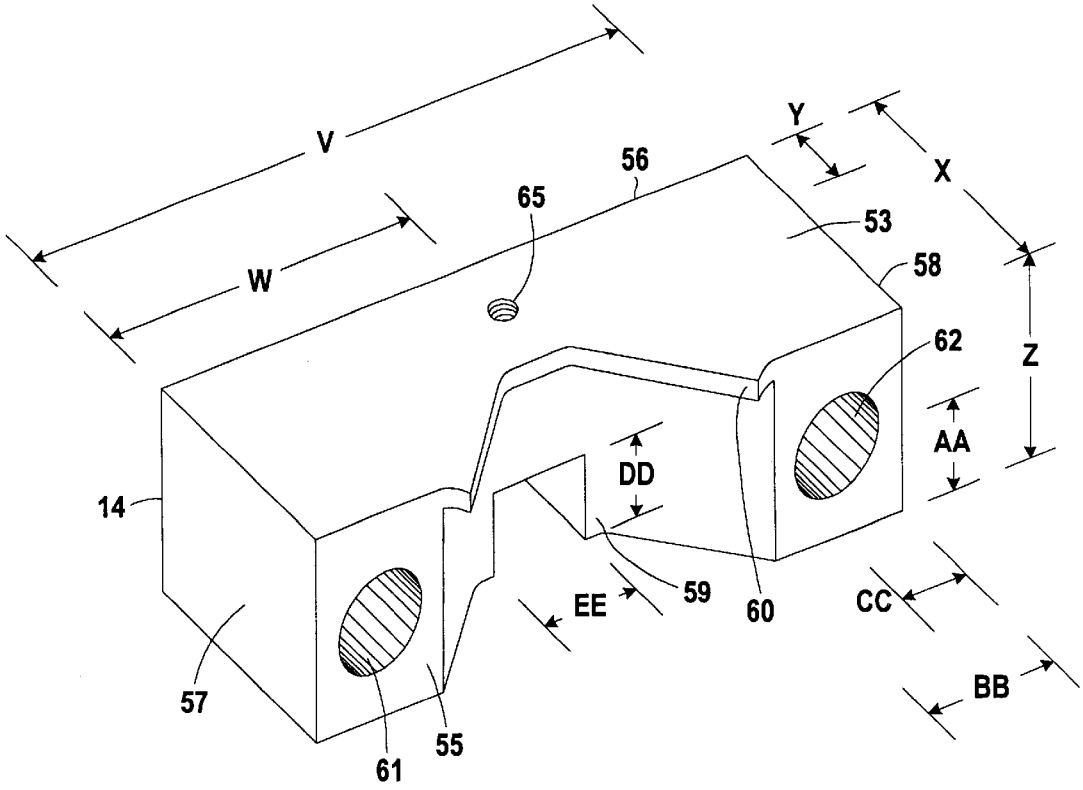
FIG. 7 is a top perspective view of a clamping block component of the device of FIG. 1.
Figure 8:
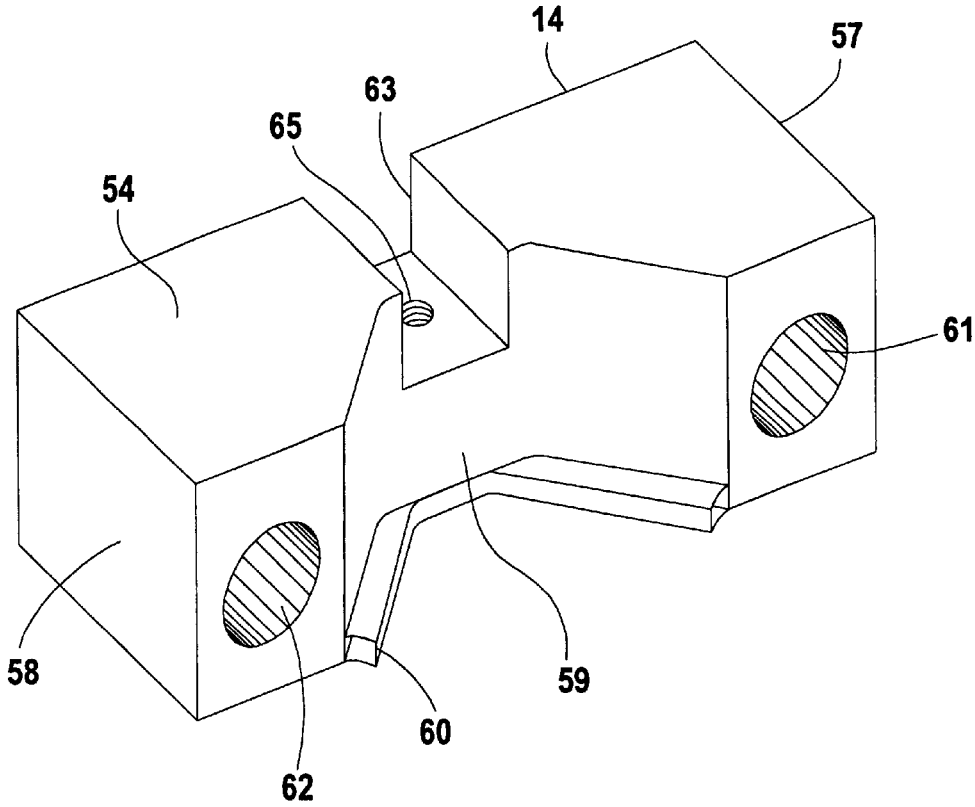
FIG. 8 is a bottom perspective view of the clamping block component of FIG. 7.

Turning to FIGS. 7 and 8, the clamping block 14 preferably includes a top 53, bottom 54, notched front 55, back 56, and opposite sides 57 and 58. An angled notched surface 59 is preferably included on the front 55 of the clamping block 14. A lip 60 is preferably located around the top of the notched surface 59. As will be appreciated, the profile of the surface 59 is substantially the shape of a pyramid.

To facilitate installation of the positioning systems 18 and 20, and the roller assembly 22, various bores, apertures, and the like may be provided on the block 16. For example, apertures 61 and 62 are preferably located through the block from the front 55 to the back 56 for receiving portions of the positioning systems 18 and 20. Also, a square notch 63 is preferably located from the center of the notched surface 59, through the block, to the back 56 for cooperating with the roller assembly 22 and a threaded aperture 65 extends through the block from the top to the notch 63 for attachment of the roller assembly 22 to the block 14.

Positioning Systems 18 and 20

Returning to FIGS. 1 and 2, each of the positioning systems 18 and 20 preferably includes a rod 68 having a threaded end 68*a* opposite a head 68*b*, a compression spring 70, and a sleeve 72.

The sleeves 72 of the positioning systems 18 and 20 are preferably compression fit into the apertures 61 and 62 of the clamping block 14 and located so as contact the stationary block 16 when the clamping block 14 is a desired distance from the stationary block 16 and limit travel of the clamping block 16. The rods 68 are slidably positioned through the sleeves 72 and the apertures 61 and 62, with the threaded ends 68*a* received by the threaded apertures 51 and 52 of the stationary block. The compression springs 70 are located on the positioning system rods 68 between the rod heads 68*b* and back 56 of the block 14.

As will be appreciated, the springs 70 urge the clamping block 14 toward the stationary block 16 in the assembled device 10. For example, with reference to FIGS. 9 and 10, there is seen a golf ball 73 frictionally retained adjacent the base 12 between the clamping block 14 and the stationary block 16. The force provided by the springs 70 as well as the topographic features of the blocks 14 and 16, such as the lips, angled surfaces, and the like, cooperate to firmly retain the golf ball and inhibit rotational and other movement. As will be appreciated, reliable positioning and restraint of the workpiece is advantageous to the treatment thereof, such as printing of indicia thereon.

Guide Roller Assembly 22

Figure 9:
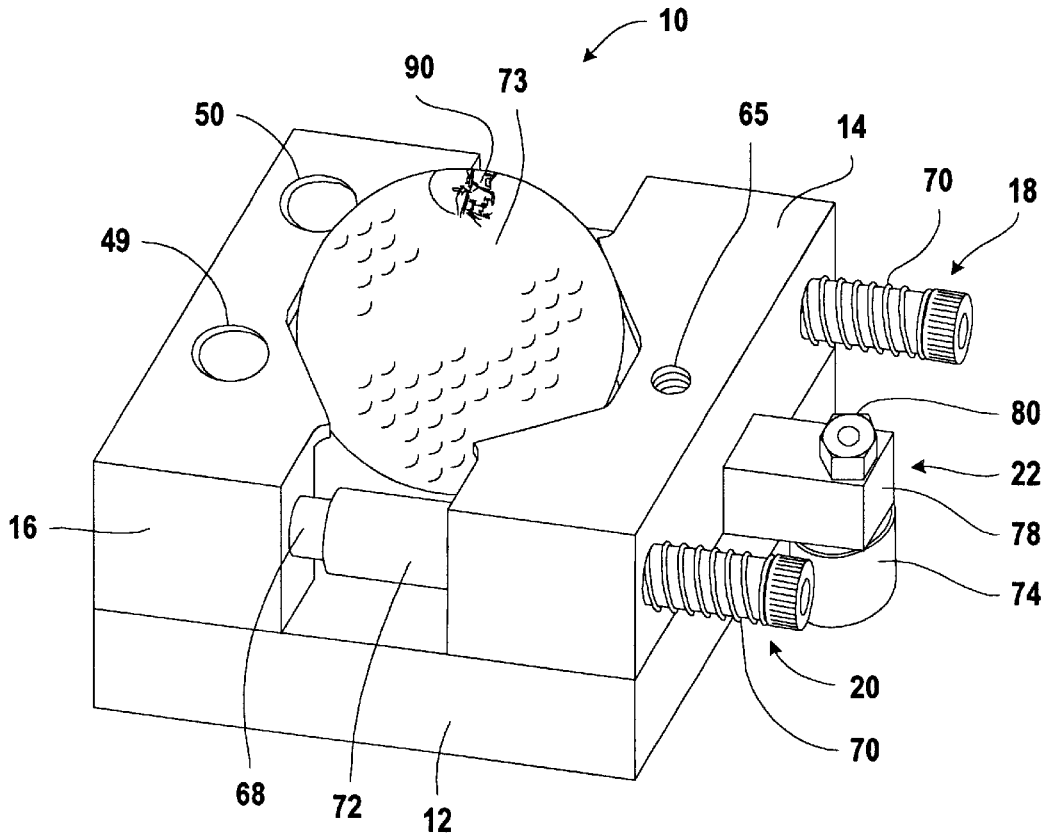
FIG. 9 is a perspective view of the device of FIG. 1 having a golf ball positioned therein.
Figure 10:
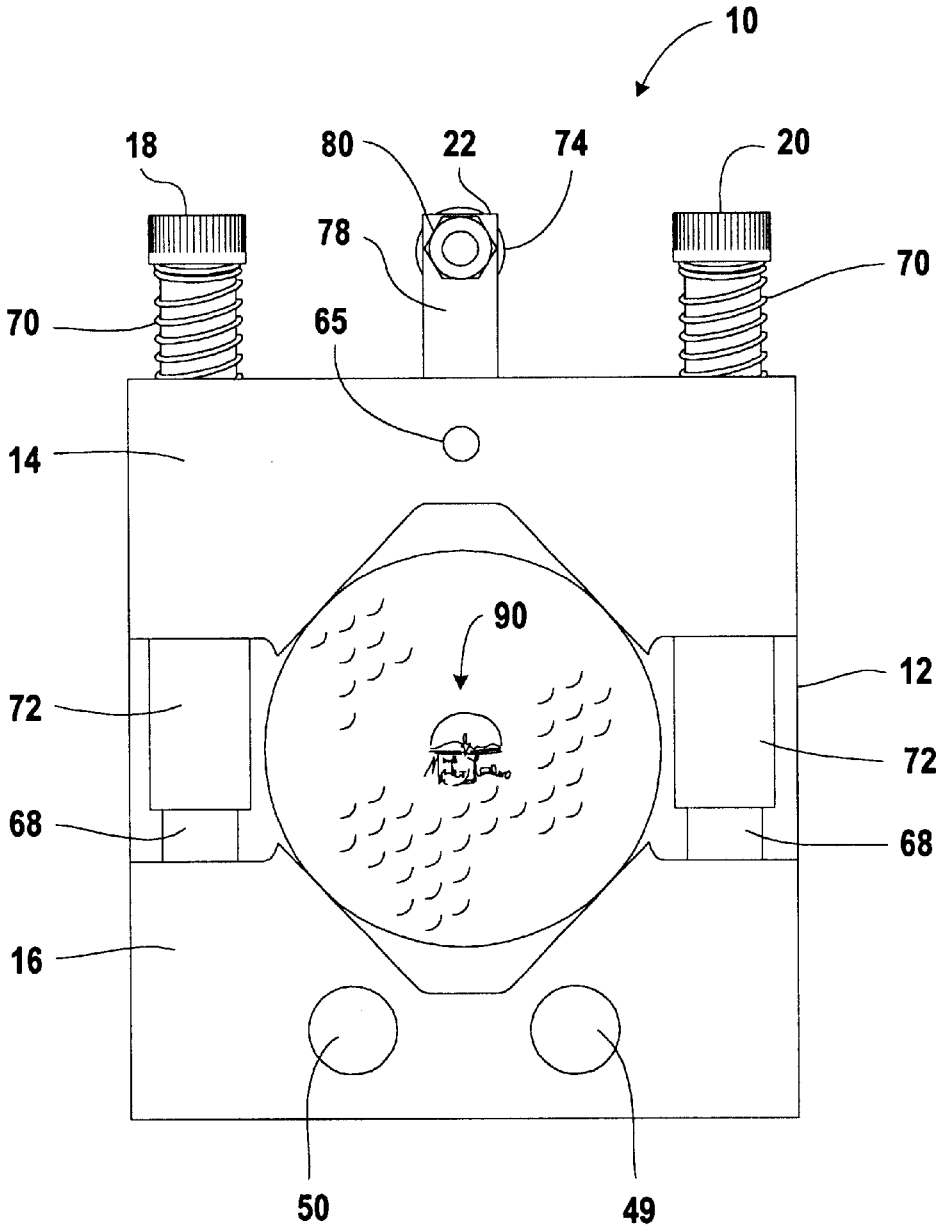
FIG. 10 is a top plan view of the device of FIG. 9.

The guide roller assembly 22 is preferably provided to facilitate integration of the device 10 into an automated process wherein a plurality of workpieces are traveled past a work station for treatment. With reference to FIGS. 2 and 9, and in a preferred embodiment, the assembly 22 may include a roller bearing 74 mounted on a threaded rod 76, a guide shaft 78, and a nut 80. The guide shaft 78 includes an aperture 82 and a aperture 84 having two different diameters. The roller bearing 74 may be mounted to the guide shaft as by threading the nut 80 onto the end of the threaded rod 76, which runs through the guide shaft aperture 82. The guide roller assembly 22 is preferably mounted on the clamping block with a screw positioned in the threaded aperture 65 of the clamping block and the aperture 84 of the guide rail.

Figure 11:
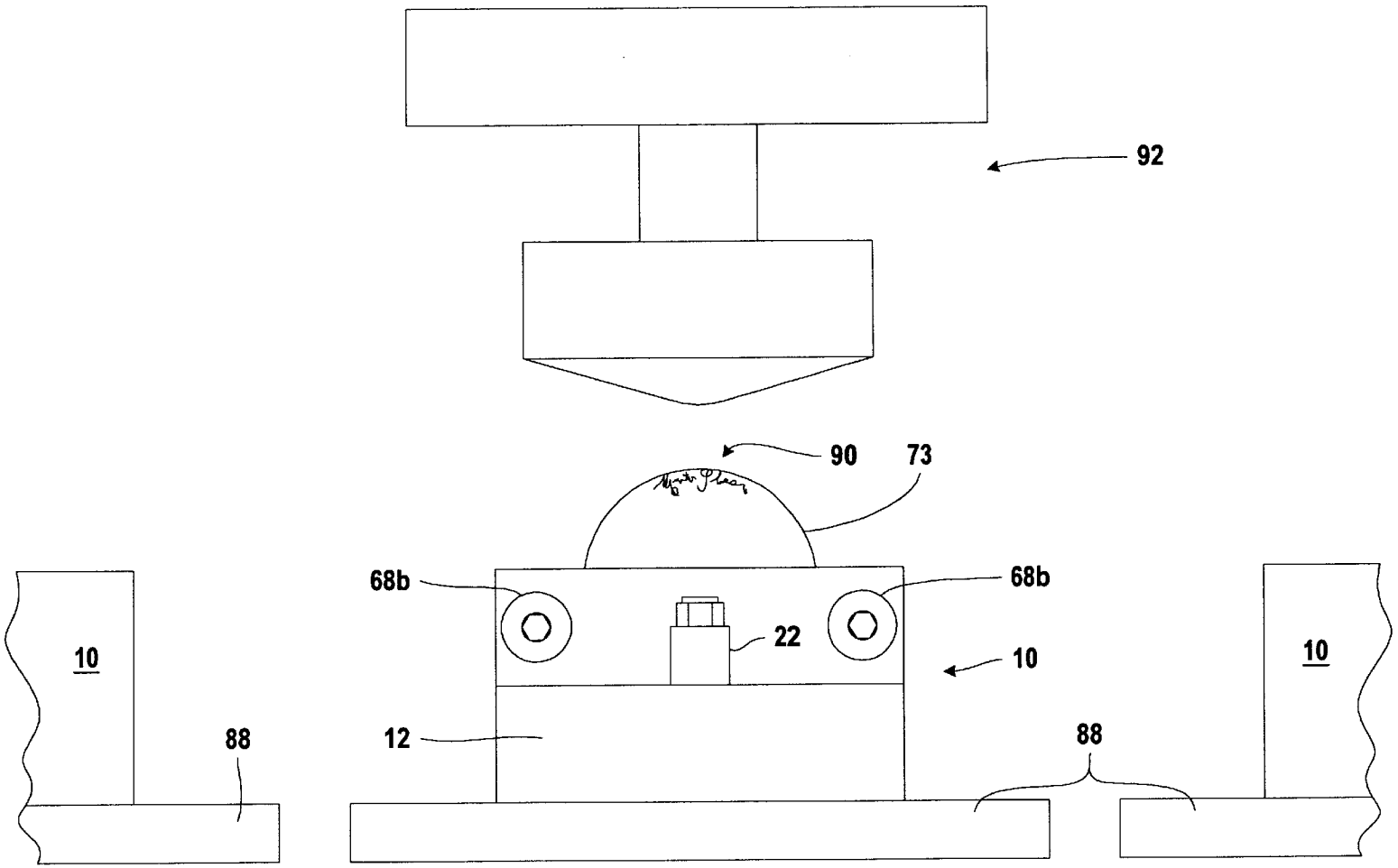
FIG. 11 shows the device of FIG. 1 with a guide roller assembly thereof engaging a guide rail of a conveying system.

With reference to FIG. 11, a plurality of the devices 10 may be advanced as by a conveyor system 88 for treatment of the workpiece held thereby. For example, treatment may include the printing or application of indicia 90 on the golf ball 73 by a printer 92.

In this regard, the conveyor system 88 may be conventional conveying equipment having a suitable surface or surfaces onto which the device 10 or multiple devices 10 may be attached or otherwise interfaced with to enable continuous or incremental advancement of devices holding workpieces through the treatment zone. For example, it is preferred that the golf ball 73 be stationary during the printing step, and thereafter advanced to an unloading/loading zone where the treated ball is removed from the device 10 and an untreated ball loaded into the now empty device 10 for treatment.

Figure 12:
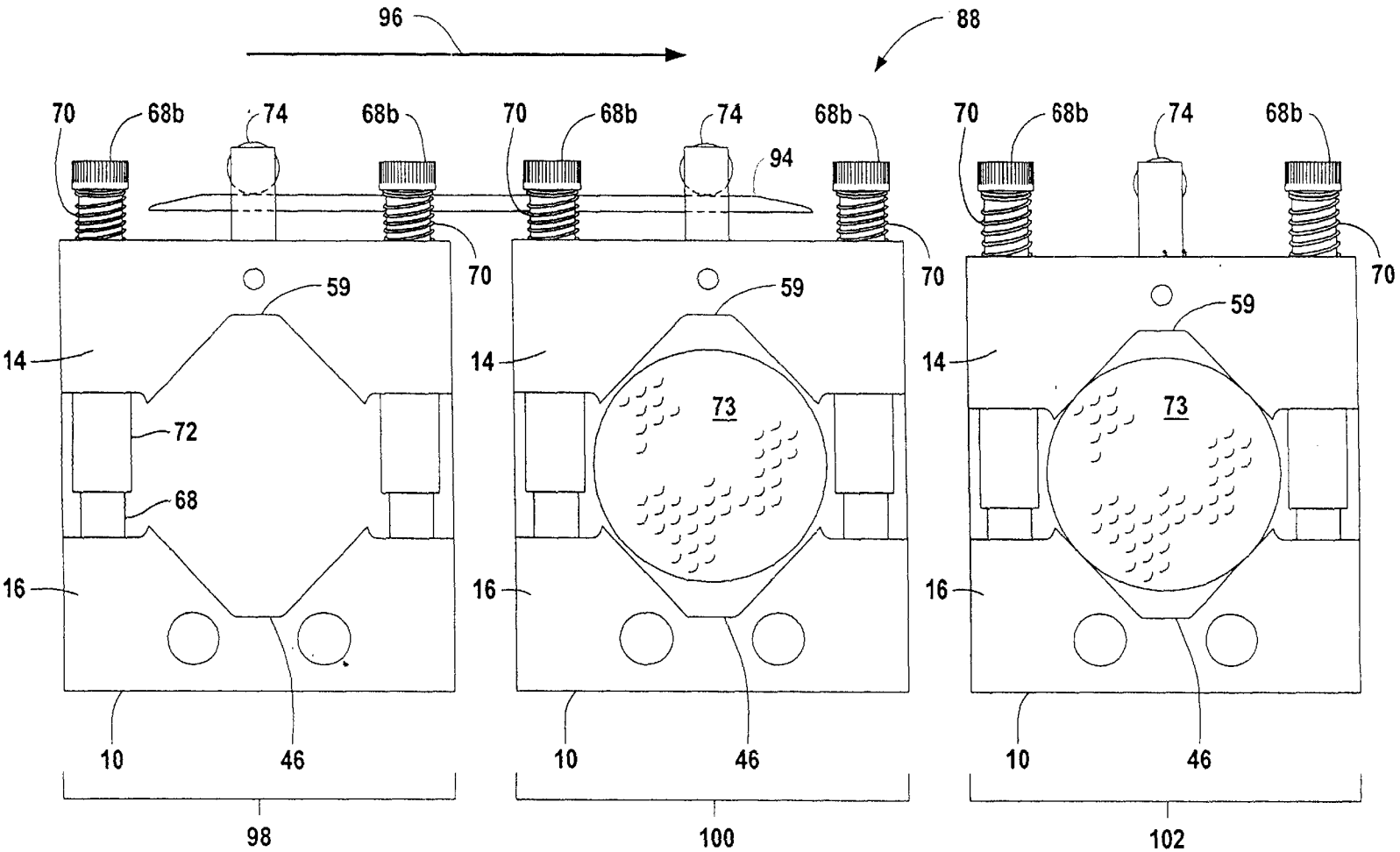
FIG. 12 shows a plurality of the devices of FIG. 1 cooperating with a conveyor system for automated travel of devices holding golf balls through a workstation, such as a printing station.

With reference to FIG. 12, the roller assembly 22 is preferably configured for enabling the device 10 to interact with a conveyor system 88 to cooperate with the positioning systems 16 and 18 to enable automated application and removal of an external force for loading and unloading of workpieces from the devices 10.

For example, the external force is preferably supplied by a guide rail 94 associated with the conveyor system 88 and cooperating with the guide roller assembly 22 to enable automated application and removal of an external force to facilitate loading and unloading of workpieces from the device 10. The roller bearing 74 is positioned to follow the guide rail 94 when the conveyor system 88 travels in the direction of the arrow 96 and through stages 98, 100 and 102. The ends the guide rail 94 are preferably tapered to guide the bearing 74 onto and off of the guide rail 94.

In stage 98, the guide rail 94 has applied an external force to guide the bearing 74 away from the base 12, causing the clamping block 14 to pull away from the stationary block 16 to allow for loading of a golf ball for treatment (stage 100) and/or unloading of a ball following treatment. In stage 102, the device 10 has traveled downline and the bearing 74 no longer contacts the guide rail such that the external force supplied by the guide rail 94 has been removed. As will be appreciated, in the absence of the external force, the springs 70 urge the clamping block 14 toward the stationary block 16 such that the ball 73 is frictionally retained for treatment. After treatment, the device 10 may travel back to the stage 98 (or another similar stage) for removal.

For the purpose of an example, the device 10 is preferably dimensioned as set forth in Table 1 below. However, it will be appreciated that the devices may be provided in various configurations and dimensions to enable its use in various applications.

TABLE 1

| Dimension | Distance (inches) |
|---|---|
| A | 3 |
| B | 1½ |
| C | ⅝ |
| D | ⅝ |
| E | 3 |
| F | ⅜ |
| G | 1 |
| H | ⅜ |
| I | 1 |
| J | 1 |
| K | 3 |
| L | 1 |
| M | 1 |
| N | 1 |
| O | 1⅛ |
| P | 7/16 |
| Q | ½ |
| R | ⅝ |
| S | 5/16 |
| T | 1¾ |
| U | 5/16 |
| V | 3 |
| W | 1½ |
| X | 1⅛ |

TABLE 1-continued

| Dimension | Distance (inches) |
|---|---|
| Y | 5/16 |
| Z | 1 |
| AA | ½ |
| BB | ⅝ |
| CC | 5/16 |
| DD | ½ |
| EE | ½ |

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A system for holding and conveying an object through a treatment zone, the system comprising, a conveyor system having a guide rail and a holder operatively associated with the conveyor system for holding the object, wherein the holder comprises a base attachable to the conveyor system to enable the conveyor system to travel the holder in a desired direction, a first member fixedly secured to the base, the first member having an object engaging surface configured for mateably engaging a first surface of the object to be held; a second member located adjacent the base and the first member and being movably positionable relative to the first member and the base, the second member having an object engaging surface configured for mateably engaging a second surface of the object to be held; and a positioning system associated with the second member for movably positioning the second member relative to the first member and the base, the positioning system including a rod extending between the first and second members, the rod being fixedly connected to the first member and slidably received by the second member, a spring positioned on the rod and located so as to bear against a portion of the second member to urge it toward the first member, and a guide member connected to the second member and positioned so as to engage the guide rail of the conveyor assembly as the holder is conveyed by the conveyor system in the desired direction wherein when the guide member is in engagement with the guide rail, the second member is urged in a direction generally away from the first member.

* * * * *